US006125486A

United States Patent [19]

Rabon

[11] Patent Number: 6,125,486

[45] Date of Patent: Oct. 3, 2000

[54] SEAT FOR TREATING PROSTATITIS

[75] Inventor: Larry D Rabon, Timmonsville, S.C.

[73] Assignee: Larry D. Rabon, Florence, S.C.

[21] Appl. No.: 09/348,412

[22] Filed: Jul. 7, 1999

Related U.S. Application Data

[60] Provisional application No. 60/107,055, Nov. 4, 1998.

[51] Int. Cl.[7] ..... A47C 27/08

[52] U.S. Cl. ..... 5/654; 297/452.41; 297/452.55

[58] Field of Search ..... 5/654, 644, 653, 5/655.3; 297/452.41, 452.55; 128/98.1, 118.1; D6/601, 604

[56] References Cited

U.S. PATENT DOCUMENTS

| | | | |
|---|---|---|---|
| D. 340,379 | 10/1993 | Cain | D6/601 |
| 484,367 | 10/1892 | Hicks . | |
| 503,236 | 8/1893 | Guthrie et al. | 297/199 |
| 562,919 | 6/1896 | Sager | 297/200 |
| 584,795 | 6/1897 | Schrader | 297/199 |
| 595,111 | 12/1897 | Perry | 297/199 |
| 611,377 | 9/1898 | Davis | 297/200 |
| 674,451 | 5/1901 | Bunker | 297/21 |
| 1,468,072 | 9/1923 | Ogle | 5/654 |
| 1,823,569 | 9/1931 | Mellano | 267/117 |
| 2,099,870 | 11/1937 | Stanley et al. | 267/117 |
| 2,199,047 | 4/1940 | Fisher | 267/117 |
| 2,216,818 | 10/1940 | Kuhlman | 5/654 |
| 2,343,996 | 3/1944 | Perry | 267/117 |
| 2,627,077 | 2/1953 | Forsyth | 267/117 |
| 2,804,911 | 9/1957 | Howarth . | |
| 3,050,748 | 8/1962 | Deutinger | 5/644 |
| 3,204,678 | 9/1965 | Worcester . | |
| 3,763,972 | 10/1973 | Karzmar | 297/118 |
| 4,116,310 | 9/1978 | Shields | 190/42 |
| 4,429,915 | 2/1984 | Flager | 297/199 |
| 4,445,240 | 5/1984 | Voorhees | 5/654 |
| 4,604,987 | 8/1986 | Keltner . | |
| 4,783,120 | 11/1988 | Kiechlin | 297/230 |
| 4,783,866 | 11/1988 | Simmons et al. | 5/644 |
| 5,079,785 | 1/1992 | Garcia | 5/654 |
| 5,121,962 | 6/1992 | Weber et al. | 297/200 |
| 5,144,705 | 9/1992 | Rogers | 5/654 |
| 5,191,665 | 3/1993 | Breedlove | 5/656 |

FOREIGN PATENT DOCUMENTS

| | | | |
|---|---|---|---|
| 316265 | 5/1989 | European Pat. Off. | 5/654 |
| 2410624 | 9/1975 | Germany | 5/654 |
| 197712 | 12/1977 | U.S.S.R. | 297/116.3 |
| 319630 | 9/1929 | United Kingdom | 5/654 |

OTHER PUBLICATIONS

NIDDK Research Plan May Rewrite Book on Prostatitis by Penny Allen, Urology TImes vol. 24, No. 6, pp. 9–11.

*Primary Examiner*—Alexander Grosz
*Attorney, Agent, or Firm*—Michael E. Wever; Michael A. Mann; Nexsen, Pruet, Jacobs & Pollard

[57] ABSTRACT

A seat for treating and reducing the occurrence of prostatitis. The seat may be adapted to or formed into any chair, vehicle seat, or any other like device. In particular, the adaptation of the seat in a rough-riding vehicle would reduce perineal trauma. The seat comprises an inflatable tube having a hole therethrough that is surrounded by a shoulder and with a cushion in the hole. Although the shoulder is very firm, the cushion is soft and provides relatively no resistance. The user sits in the tube and as a result pressure to the perineum is avoided and pressure is supported by the legs, hip or rear area.

16 Claims, 1 Drawing Sheet

SEAT FOR TREATING PROSTATITIS

PRIORITY CLAIM

This application claims the benefit of U.S. Provisional Application No. 60/107,055, filed on Nov. 4, 1998.

FIELD OF THE INVENTION

The present invention relates to a device for treating prostatitis. In particular, the present invention relates to a seat for reducing the occurrence of and providing relief from prostatitis.

BACKGROUND OF THE INVENTION

The current definition of prostatitis has been put forward by Dr. John Krieger as Chairman of Research and Clinical Definitions Group at the National Institute of Diabetes and Digestive and Kidney Diseases, (NIDDK). Under the NIH/NIDDK system, the nomenclature consists of four main categories: acute bacterial prostatitis, chronic bacterial prostatitis, chronic prostatitis/chronic pelvic pain syndrome (CPPS), asymptomatic inflammatory prostatitis, chronic prostatitis/chronic pelvic pain syndrome.

According to the June 1996 issue of Urology Times, various theories have been developed to resolve the cause of chronic prostatitis, especially if no infection can be detected. One theory speculates that the cause is urodynamic dysfunction. Others believe that the disease may be caused by psychological factors. While others theorize that the infection is just not detected using traditional techniques.

In treating prostatitis, many urologists prescribe antibiotics, even if an infection is not detected; however, since this standard practice does not provide effective relief for most patients, many other treatments have been offered. Intrusive solutions, such as alpha blockers, anti-inflammatory drugs, and hyperthermia have not resulted in a successful treatment either. Even more intrusive measures such as TURP, balloon dilatation, bladder neck incision, radical prostatectomy, and cystoprostatectomy have also been tried to no avail. Researchers are currently performing studies on "nonbacterial" prostatitis in order to determine if it may be caused by occupation or recreational hazards from riding in rough driving vehicles.

CPPS plus many cases of acute prostatitis may be caused by trauma to the perineum from riding in rough driving vehicles. It is common knowledge that the Jeep drivers of WWII suffered from painful prostates, which was conceivably caused by driving a four wheel drive, heavily sprung, vehicle across rough terrain. If perineal trauma is the primary cause of most cases of prostatitis, then CPPS could be an occupational and/or recreational hazard and not a bacterial, viral or fungal infection. Persons driving pickup trucks, farm tractors, 18 wheel trucks, fork lifts, motorcycles, back hoes, bull dozers or any other rough riding vehicles are at risk of perineal trauma; consequently, many users of these rough riding vehicles suffer from prostatitis. In order to get relief from flare ups caused from prostatitis, these persons must take prescription medications or be subjected to even more intrusive measures. Therefore, there is a need for a unintrusive device that could reduce the occurrence of and flare-ups from CPPS.

SUMMARY OF THE INVENTION

According to its major aspects and broadly stated, the present invention is a seat for treating and reducing the occurrence of prostatitis by minimizing perineal trauma.

According to a study conducted by Applicant, the number of flare-ups by patients using a seat having the main characteristics of the present invention was reduced by 75% over the course of a year. The seat may be adapted for any chair, vehicle seat, or any other like device in which a user may sit. The seat comprises an inflatable tube having a hole therethrough that is surrounded by a shoulder and with a cushion optionally inserted in the hole. Although the shoulder is very firm, the cushion is soft and provides relatively no resistance or support As the user sits on the tube, the resulting pressure is carried by the legs, hip or rear area and not the perineum.

A major advantage of the present invention is the reduction in the occurrence and flare-ups of prostatitis. As evidenced by the dramatic result of the study conducted by the Applicant, 92.3% of patients had only one or no flare-ups through the entire year of using a ring-like seat.

Use of the seat by riders in rough-riding vehicles is an important feature of the present invention. According to the study conducted by the Applicant, perineal trauma can be caused by rough-riding vehicles and as a result, the users suffer from prostatitis. With these ring-like seats in the users' vehicles, the number of flare-ups resulting from acute prostatitis episodes was reduced by 75%.

The inflatable tube is another important feature of the present invention. The tube avoids pressure on the perineum and places this stress to the legs, hip or rear area. As a result, almost 75% of persons having a prostatitis history that use the seat had no flare-ups for an entire year.

Other features and advantages of the present invention will be apparent to those skilled in the art from a careful reading of the Detailed Description of a Preferred Embodiment presented below and accompanied by the drawings.

DETAILED DESCRIPTION OF A PREFERRED EMBODIMENT

Figure 1:
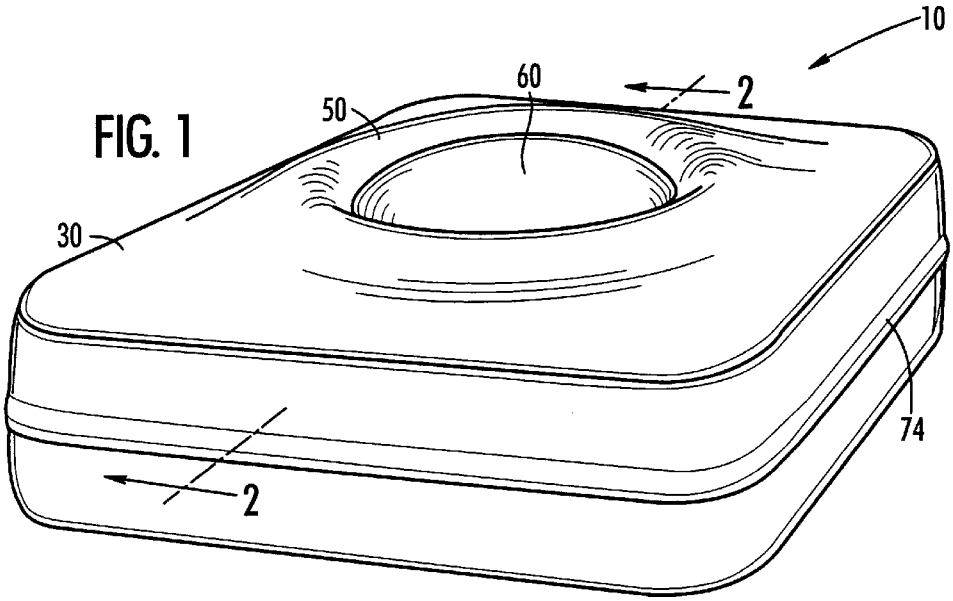
FIG. 1 is a perspective view a seat, according to a preferred embodiment of the present invention.
Figure 2:
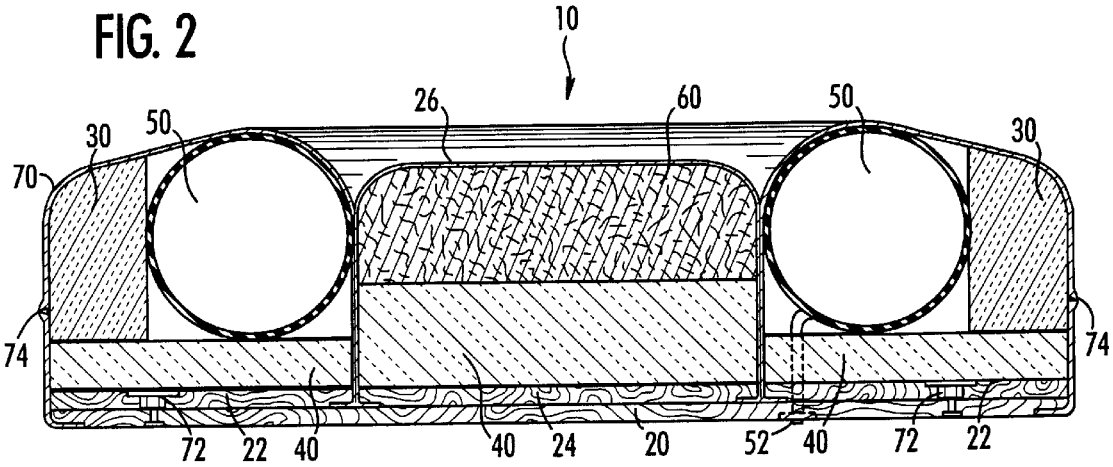
FIG. 2 is a side cross-sectional view a seat, according to a preferred embodiment of the present invention.

Referring now to the figures, the present invention is a seat for treating and reducing the occurrence of prostatitis. The seat may be adapted to or formed into any chair, vehicle seat, or any other like device that a user may sit upon. The seat, generally referred to by reference number 10, comprises an endless tube 50 surrounded by a shoulder 30 and with a cushion 60 center.

Seat 10 has a base 20 that supports the entire structure. Base 20 is preferably planar in shape and dimensioned to fit beneath the entire seat 10. Base 20 may be made from aluminum, stainless steel, plastic, rubber or any like material. A shoulder base 22 and cushion base 24 ride on base 20. Both shoulder base 22 and cushion base 24 are preferably planar in shape. Shoulder base 22 is dimensioned to support shoulder 30 while cushion base 24 is dimensioned to support cushion 60. Either shoulder base 22 or cushion base 24 could also be made from metals, stiff rubber, wood or plastic.

A shoulder 30 surrounds tube 50 along the top perimeter of seat 10. Shoulder 30 serves to focus the user on the proper positioning to maximize relief to the prostate area. Preferably shoulder 30 is made from a shock absorbing material, such as latex foam, polyurethane foam or the like, but could be made from a rigid material, such as wood, aluminum, or hard plastic. If a shock absorbent material is used for shoulder 30, it is preferably formed from polyurethane having 55 pound indentation load deflection.

An endless, ring-shaped tube 50 is positioned within shoulder 30. Although tube 50 may be solid and formed from a resilient material, preferably tube 50 is inflatable to various pressures using valve 52. The air pressure within tube depends upon the comfort of the user and should be inflated to a pressure that avoids pressure on the prostate or perineum area generally and places it on the legs, hip or rear area of the spine. Tube 50 may be formed from any resilient, air-tight material, such as synthetic or natural rubber or vinyl.

An absorber 40 is positioned below shoulder 30, tube 50 and cushion 60. Absorber 40 may be made from any shock-absorbent material that could provide resistance, such as rubber, latex foam, polyurethane foam. Preferably, absorber is formed with polyurethane foam characterized by 20 pound indentation load deflection.

Cushion 60 fills center of tube 50 and is positioned above absorber 40. Cushion 60 is preferably dimensioned to a similar thickness as that of tubing 50 to provide a relatively top flush surface to seat 10. Cushion 60 could be made from any relatively soft material that would provide low impact resistance and relatively no support to the perineum. Preferably cushion 60 is made from a polyester fiber sold under the name DACRON™.

A cover extends over the entire assembly. Cover is a relatively thin material that protects assembly from moisture and damage. Cover could be made from any material that furniture is upholstered with, such as leather, fabric, vinyl or the like. Optionally, cover is closed with a slide fastener 74 so that it can be removed easily in order to allow removal of tube 50. Cover is attached to base 20 using fasteners 72.

In use, a person inflates tube 50 until the desired pressure is reached, then sits on tube 50 of seat 10. Since cushion 60 is soft and offers little resistance, the weight of the individual is transmitted through the legs, hip or rear area and not the perineum.

In order to test the theory underlying the present invention, Applicant conducted a study with patients suffering from prostatitis. The study was conducted with a tube, but not the seat herein described. Between Oct. 21, 1995 and Jun. 20, 1997, 104 patients with repeated doctor visits for symptoms of prostatitis were selected for study. The patients had driven rough riding vehicles for years. Many of them drove more than one type of rough riding vehicle. Common vehicles driven were pickup trucks, farm tractors, 18 wheeler trucks, fork lifts, bicycles, motorcycles, back hoes, and bull dozers. All 104 patients had a painful prostate/urogenital diaphragm area on rectal examination, plus various combinations of other symptoms including voiding symptoms and sexual dysfunction. All 104 patients had a negative urinalysis and negative urine for culture. White blood cells in prostatic secretions was not used as a criteria for inclusion or exclusion.

A total of 104 men chosen at random and consecutively successfully completed a year riding on inflated ring-shaped tubes. Of these men, 78 used the ring, plus antibiotics and 26 of these men used a ring as the only treatment. The patients were given a prescription for an antibiotic (Bactrim, Cipro or Doxcycline) and the ring-shaped cushion with instructions to try to use the cushion alone and if necessary, fill the prescription. A comparison was made between the flare-ups of CPPS for a year prior to the use of the cushion to the year riding on the cushion with or without antibiotics.

Seventy-eight patients, or 75%, filled the prescriptions, plus rode on the cushion and 26 patients or 25% used the cushion with no antibiotics for a total of 104 patients who rode on the cushion for one year. Compliance for using the cushion while driving rough-riding vehicles was 90% of the time.

A total of 231 episodes of CPPS occurred in 104 men the year prior to the use of the cushion. This number of flare-ups was reduced to 57 during the year on the cushion. This was a 75% reduction in the number of flare-ups. An additional 30 (29%) patients had only one flare-up during the year on the cushion. An impressive 89.3% of the people using the cushion had one episode or less compared to 37% the previous year without the cushion. Close to 90% of the men had one flare-up or less, in one year, if they used the cushion with or without antibiotics.

The population of patients who used the cushion with no other treatment had fewer flare-ups than the patients with the cushion and antibiotics. Almost ¾ (73.1%) had no flare-ups for a year. An additional 19.2% had one flare-up for a total of 92.3% with one or less flare-ups for the year on the cushion.

The testing conducted by Applicant suggests that CPPS, as well as some episodes of acute prostatitis, is due to perineal trauma due to rough riding vehicles. If the inflatable seat 10 of the present invention were added to, or built into, the seats of these vehicles, a dramatic reduction in the number of patients diagnosed with prostatitis would likely occur.

It will be apparent to those skilled in the art that many changes and substitutions can be made to the preferred embodiment herein described without departing from the spirit and scope of the present invention.

What is claimed is:

1. A seat for treating prostatitis, said seat comprising:

a base;

an endless tube having a hole therethough, said tube having sufficient rigidity that would allow a user sitting on said tube to shift pressure away from the perineum area;

a first absorber carried in said hole in said tube, said first absorber made from a shock-absorbent material;

a second absorber carried by said base, said second absorber made from a shock-absorbent material, said tube carried by said second absorber;

a cushion positioned in said hole in said tube, said cushion having a thickness that is similar to that of said tube so that said cushion will be substantially flush with said tube, said cushion made from a material that provides substantially no impact resistance to the perineum of a user sitting on said tube.

2. The seat as recited in claim 1, wherein said tube is capable of being inflated to a pressure that allows a user sitting on said tube to shift pressure from the perineum area and said tube has means for adjusting pressure within said tube.

3. The seat as recited in claim 2, wherein said second absorber is made from a shock-absorbent material having a 20 pound indentation load deflection.

4. The seat as recited in claim 2, wherein said first absorber is made from a shock-absorbent material having a 20 pound indentation load deflection.

5. The seat as recited in claim 2, further comprising a cover that surrounds said tube to prevent moisture from entering.

6. The seat as recited in claim 2, wherein said first absorber and said second absorber are formed from a material selected from the group consisting of rubber, latex foam, and polyurethane foam.

7. The seat as recited in claim 1, wherein said second absorber is made from a shock-absorbent material having a 20 pound indentation load deflection.

8. The seat as recited in claim 7, wherein said first absorber is made from a shock-absorbent material having a 20 pound indentation load deflection.

9. The seat as recited in claim 7, further comprising a cover that surrounds said tube to prevent moisture from entering.

10. The seat as recited in claim 7, wherein said first absorber and said second absorber are formed from a material selected from the group consisting of rubber, latex foam, and polyurethane foam.

11. The seat as recited in claim 1, wherein said first absorber is made from a shock-absorbent material having a 20 pound indentation load deflection.

12. The seat as recited in claim 11, further comprising a cover that surrounds said tube to prevent moisture from entering.

13. The seat as recited in claim 11, wherein said first absorber and said second absorber are formed from a material selected from the group consisting of rubber, latex foam, and polyurethane foam.

14. The seat as recited in claim 1, further comprising a cover that surrounds said tube to prevent moisture from entering.

15. The seat as recited in claim 14, wherein said first absorber and said second absorber are formed from a material selected from the group consisting of rubber, latex foam, and polyurethane foam.

16. The seat as recited in claim 1, wherein said first absorber and said second absorber are formed from a material selected from the group consisting of rubber, latex foam, and polyurethane foam.

* * * * *